US009295885B2

(12) United States Patent
Matsunaga et al.

(10) Patent No.: US 9,295,885 B2
(45) Date of Patent: Mar. 29, 2016

(54) GOLF CLUB

(71) Applicant: DUNLOP SPORTS CO. LTD., Kobe-shi, Hyogo (JP)

(72) Inventors: Kiyofumi Matsunaga, Kobe (JP); Naruhiro Mizutani, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 0 days.

(21) Appl. No.: 14/326,874

(22) Filed: Jul. 9, 2014

(65) Prior Publication Data

US 2015/0031468 A1 Jan. 29, 2015

(30) Foreign Application Priority Data

Jul. 23, 2013 (JP) ..... 2013-152398

(51) Int. Cl.
*A63B 53/06* (2015.01)
*A63B 53/02* (2015.01)
*A63B 53/04* (2015.01)

(52) U.S. Cl.
CPC ..... *A63B 53/02* (2013.01); *A63B 53/0466* (2013.01); *A63B 53/06* (2013.01); *A63B 60/52* (2015.10); *A63B 2053/023* (2013.01); *A63B 2053/0433* (2013.01); *A63B 2053/0491* (2013.01)

(58) Field of Classification Search
CPC .... A63B 53/02; A63B 53/0466; A63B 49/06; A63B 2053/0491; A63B 2053/0433; A63B 2053/023; A63B 60/52
See application file for complete search history.

(56) References Cited

U.S. PATENT DOCUMENTS

| | | | | |
|---|---|---|---|---|
| 8,790,195 | B1 * | 7/2014 | Myers | A63B 53/0466 473/335 |
| 8,876,622 | B2 * | 11/2014 | Beach | A63B 53/02 473/244 |
| 2004/0092332 | A1 * | 5/2004 | Willett | A63B 53/0466 473/338 |
| 2011/0152000 | A1 | 6/2011 | Sargent et al. | |
| 2012/0122601 | A1 | 5/2012 | Beach et al. | |
| 2012/0172142 | A1 | 7/2012 | Yashiki | |
| 2014/0080629 | A1 * | 3/2014 | Sargent | A63B 53/0466 473/336 |

FOREIGN PATENT DOCUMENTS

JP 2004-267460 A 9/2004

* cited by examiner

*Primary Examiner* — Stephen Blau
(74) *Attorney, Agent, or Firm* — Birch, Stewart, Kolasch & Birch, LLP

(57) ABSTRACT

A golf club 1 includes a head 3 and a shaft 5. The head 3 has a head body M3, a grounding member Y1 and a movement restricting member Y2. The head body M3 has a sole s3. The sole s3 has a slide part S1 that can slide the grounding member Y1. The movement restricting member Y2 restricts slide movement of the grounding member Y1 while allowing the grounding member Y1 to be fixed at a plurality of slide positions. A face angle can be varied depending on the plurality of slide positions of the grounding member Y1.

14 Claims, 19 Drawing Sheets

GOLF CLUB

The present application claims priority on Patent Application No. 2013-152398 filed in JAPAN on Jul. 23, 2013, the entire contents of which are hereby incorporated by reference.

BACKGROUND OF THE INVENTION

1. Field of the Invention

The present invention relates to a golf club.

2. Description of the Related Art

A golf club including an adjusting function is proposed. The adjusting function can improve the compatibility of a golf club and a golf player.

US 2011/0152000 and US 2012/0122601 disclose golf clubs including a head and a shaft detachably attached to the head. In these golf clubs, the axis of a shaft hole of a sleeve is inclined to a hosel axis. The inclination of a shaft axis enables the adjustment of a loft angle, a lie angle, and a face angle. Furthermore, these U.S. gazettes disclose a mechanism capable of adjusting a face angle. Japanese Patent Application Laid-Open No. 2004-267460 discloses a golf club head including a bottom face to which a hook angle adjusting material is firmly fixed. Japanese Patent Application Laid-Open No. 2012-139403 (US 2012/0172142) discloses a golf club including a head cavity body, a head weight, a grip cavity body, and a grip weight.

SUMMARY OF THE INVENTION

In a face angle adjusting mechanism, a degree of freedom of adjustment is preferably high. It is an object of the present invention to provide a golf club including an improved face angle adjusting mechanism.

A preferable golf club includes a head and a shaft. The head includes a head body, a grounding member, and a movement restricting member. The head body includes a sole. The sole includes a slide part that can slide the grounding member. The movement restricting member restricts slide movement of the grounding member while allowing the grounding member to be fixed at a plurality of slide positions. A face angle can be varied depending on the plurality of slide positions of the grounding member.

Preferably, the movement restricting member includes at least one positioning member that can slidingly move in the slide part, and a fixed member detachably attached to the head body. Preferably, the slide position of the grounding member is changed by a disposing order of the positioning member and the grounding member. Preferably, the slide movements of the positioning member and the grounding member are restricted by the fixed member.

In another preferable aspect, the movement restricting member is a screw body axially rotatably supported by the sole. In the aspect, the grounding member is connected to the screw body in a screwing manner. In the aspect, the slide movement of the grounding member is achieved by axially rotating the screw body.

A center of gravity of the head may move with the slide movement of the grounding member. In this case, adjustment of the center of gravity of the head moving to a back side as the face angle is opened is enabled.

If a specific gravity of the head body is defined as G1 and a specific gravity of the grounding member is defined as G2, the specific gravity G2 may be equal to or less than the specific gravity G1.

If a specific gravity of the head body is defined as G1, a specific gravity of the grounding member is defined as G2, and a specific gravity of the positioning member is defined as G3, the specific gravity G2 may be equal to or less than the specific gravity G1 and the specific gravity G3 may be equal to or less than the gravity G1.

DESCRIPTION OF THE PREFERRED EMBODIMENTS

The present invention will be described later in detail based on preferred embodiments with appropriate reference to the drawings.

Figure 1:
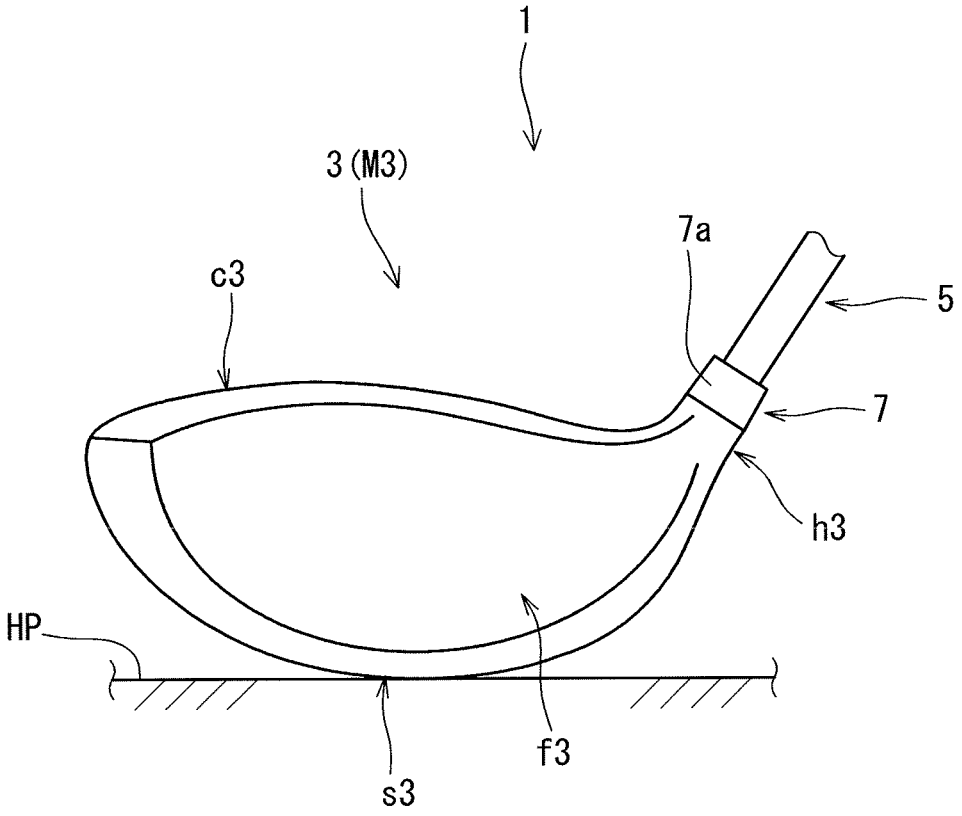
FIG. 1 shows a golf club according to a first embodiment of the present invention.
Figure 2:
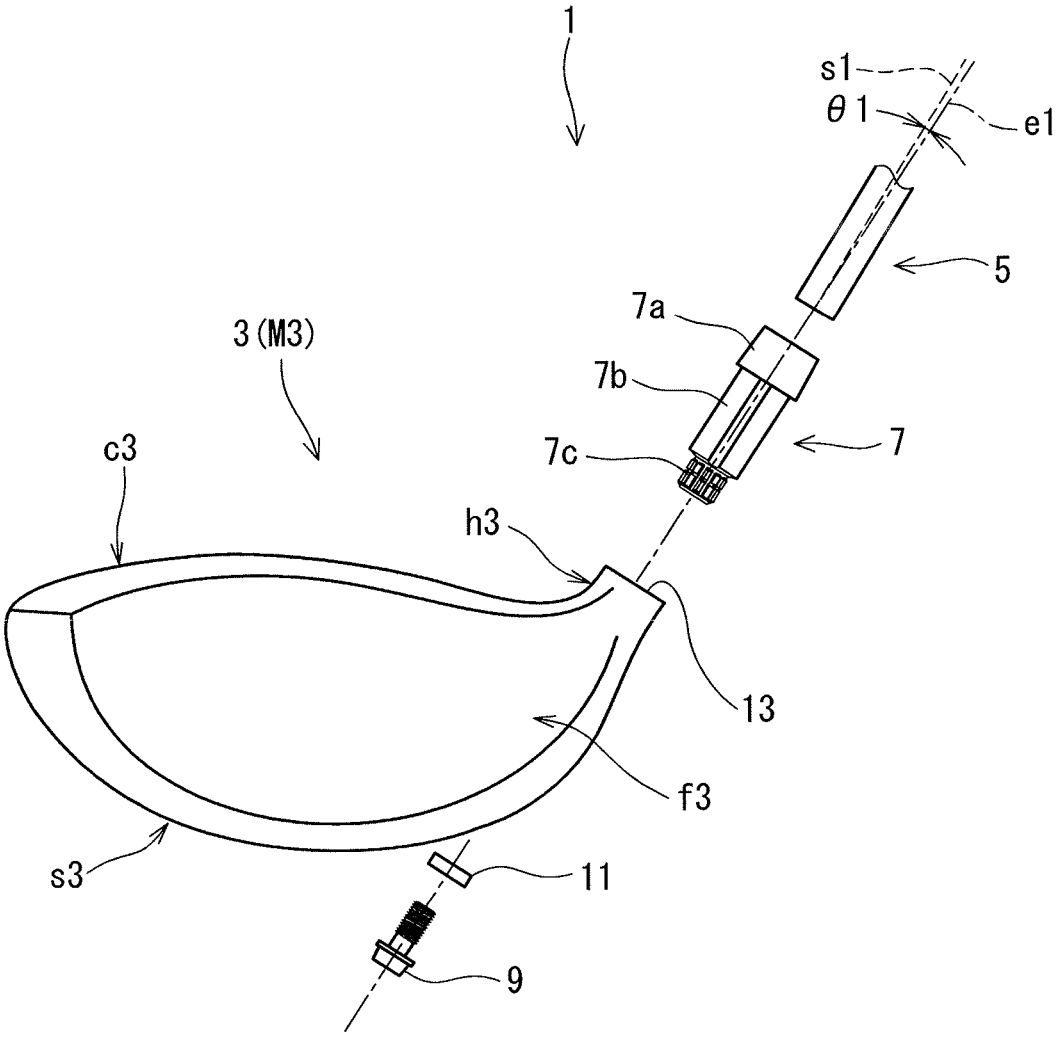
FIG. 2 is an exploded view of FIG. 1.

FIG. 1 shows a golf club 1 of a first embodiment of the present invention. FIG. 1 shows only a vicinity of a head of the golf club 1. FIG. 2 is an exploded view of the golf club 1.

The golf club 1 includes a head 3, a shaft 5, sleeve 7, and a screw 9. The golf club 1 further includes a washer 11. The sleeve 7 is fixed to a tip part of the shaft 5. The fixation is achieved by adhesion using an adhesive agent. A grip which is not shown in the figures is attached to a back end part of the shaft 5.

The head 3 includes a body M3. As shown in FIGS. 1 and 2, the body M3 includes a crown c3, a sole s3, a face f3, and a hosel h3.

The head 3 of the embodiment is a wood type golf club. However, the type of the head 3 is not limited. Examples of the head 3 include a wood type head, a utility type head, a hybrid type head, an iron type head, and a putter head. Examples of the shaft 5 include a carbon shaft and a steel shaft.

The sleeve 7 is fixed to the head 3 by fastening the screw 9. Therefore, the shaft 5 fixed to the sleeve 7 is attached to the head 3. The sleeve 7 can be detached from the head 3 by loosening the screw 9. Therefore, the shaft 5 fixed to the sleeve 7 can be detached from the head 3. Thus, the shaft 5 is detachably attached to the head 3.

Figure 3:
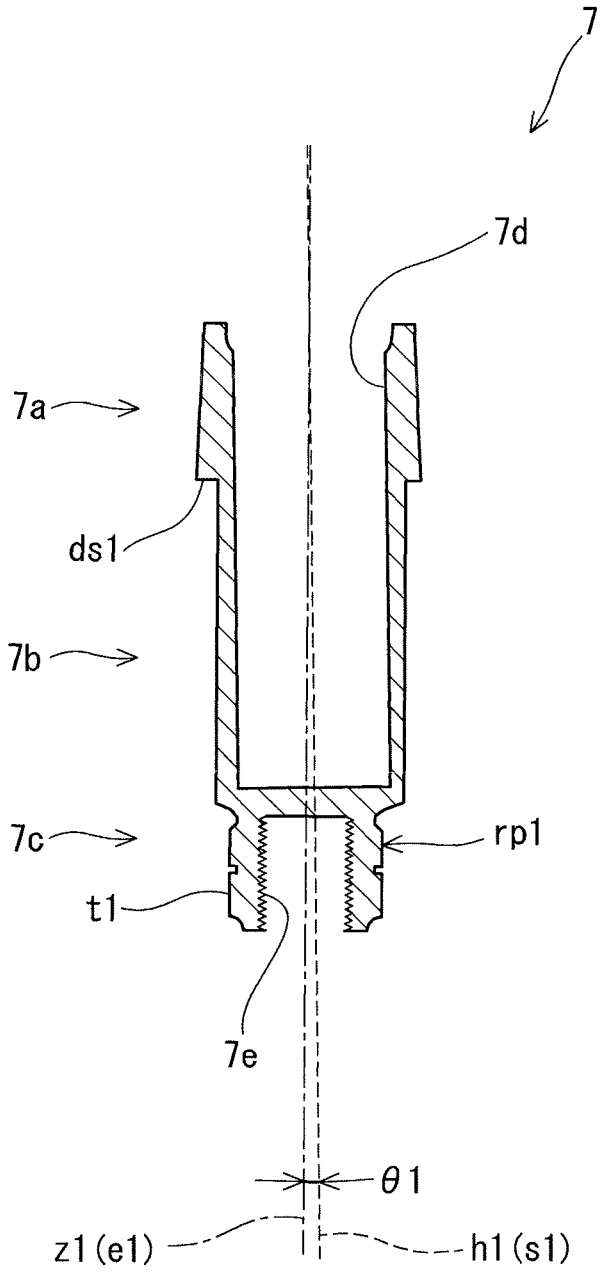
FIG. 3 is a cross-sectional view of a sleeve.
Figure 4:
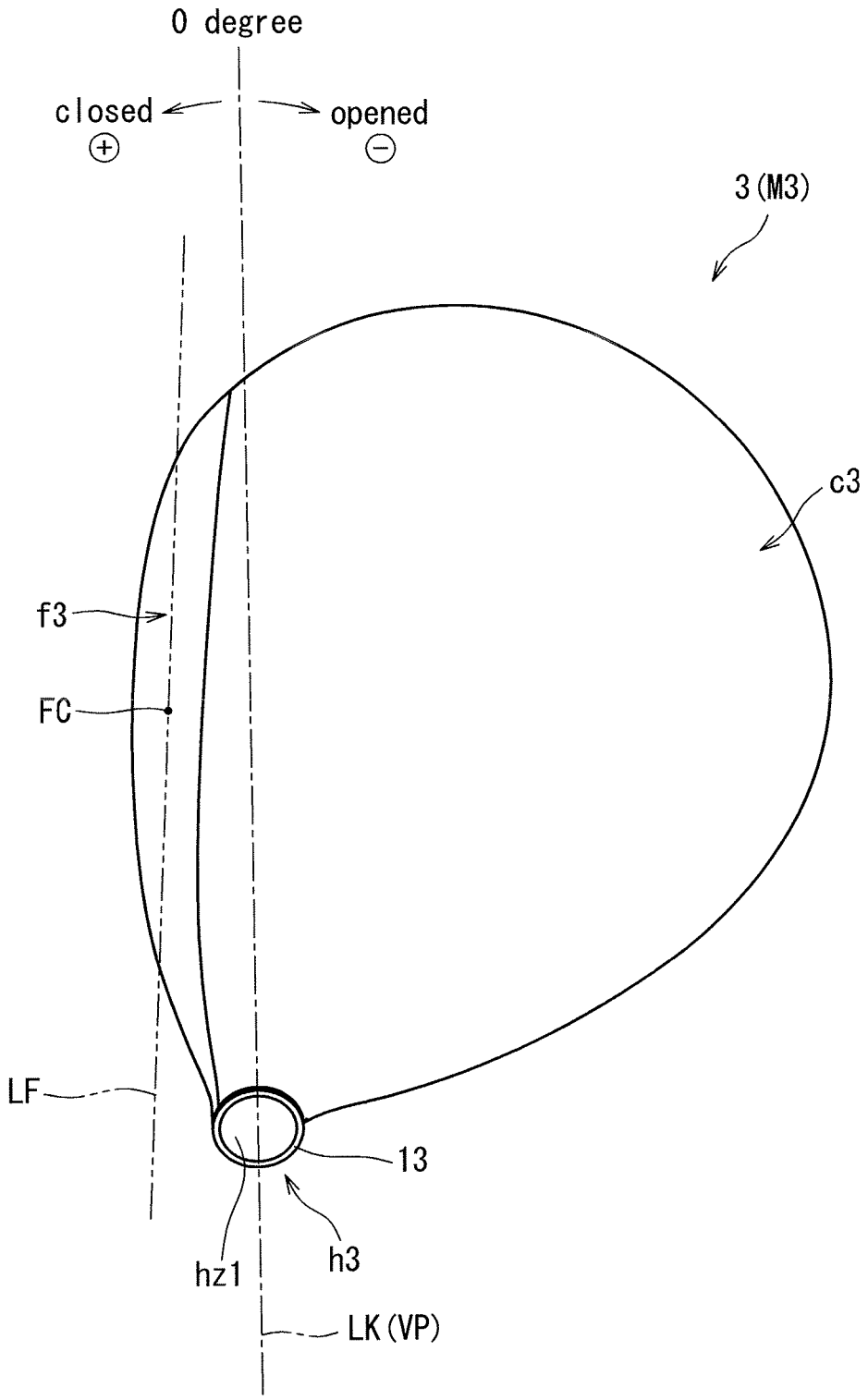
FIG. 4 is a plan view of a head.
Figure 5:
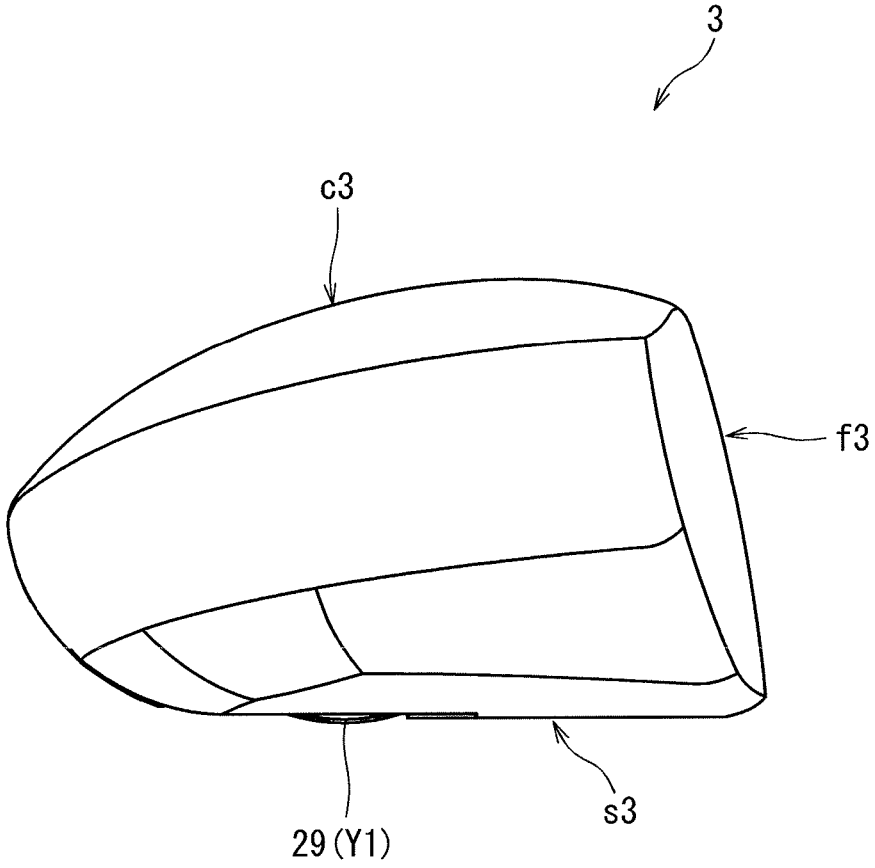
FIG. 5 is a side view of the head.
Figure 6:
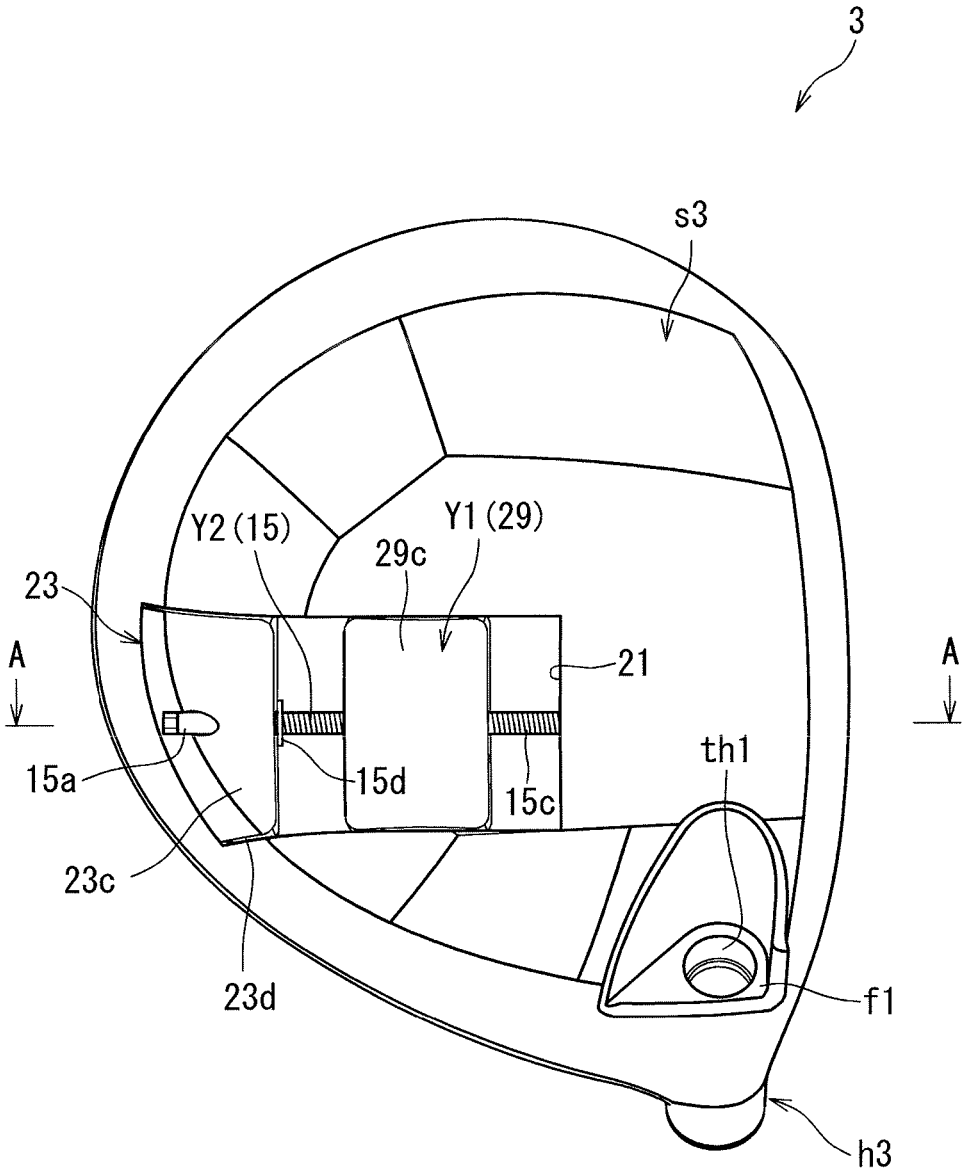
FIG. 6 is a bottom view of the head.
Figure 7:
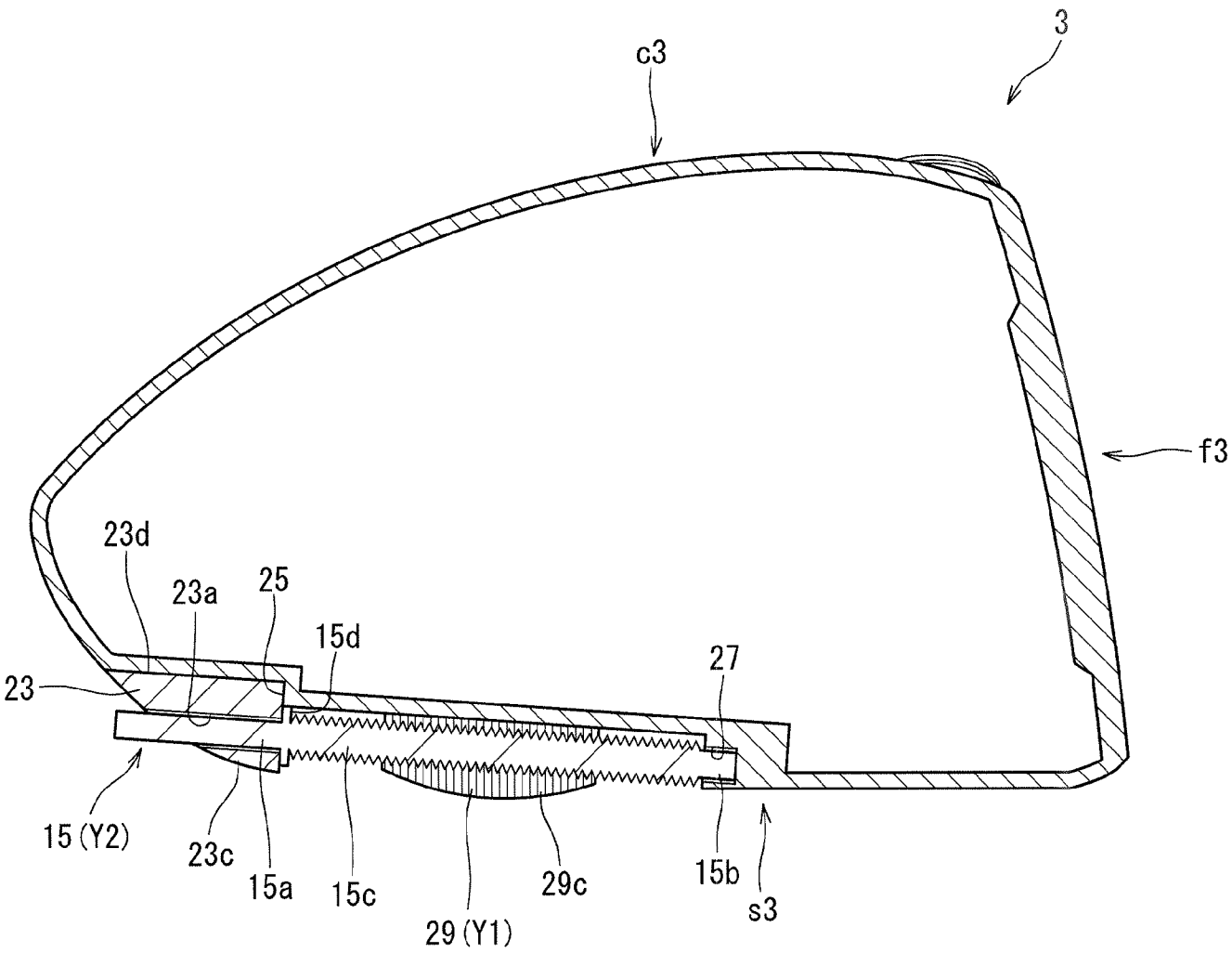
FIG. 7 is a cross-sectional view taken along line A-A of FIG. 6.

FIG. 3 is a cross-sectional view of the sleeve 7. FIG. 4 is a plan view of the head 3. FIG. 5 is a side view of the head 3. FIG. 6 is a bottom view of the head 3. FIG. 7 is a cross-sectional view taken along line A-A of FIG. 6. As shown in FIG. 7, the head 3 is hollow.

The hosel h3 has a hosel hole hz1 (see FIG. 4) into which the sleeve 7 is inserted, and a through hole th1 (see FIG. 6) into which the screw 9 is inserted. The through hole th1 passes through a bottom part of the hosel hole hz1.

The sleeve 7 includes an upper part 7*a*, an intermediate part 7*b*, and a lower part 7*c*. A bump surface ds1 is formed on a boundary between the upper part 7*a* and the intermediate part 7*b*. As shown in FIG. 3, the sleeve 7 has a shaft hole 7*d* and a screw hole 7*e*. The shaft hole 7*d* passes through the upper part 7*a*, and leads to the intermediate part 7*b*. The shaft hole 7*d* is opened to an upper side (a shaft side). The screw hole 7*e* is formed in the lower part 7*c*. The screw hole 7*e* is opened to a lower side (a sole side).

As shown in FIG. 1, in a usable assembled state, the upper part 7*a* is exposed to the outside. In the assembled state, the bump surface ds1 abuts on a hosel end face 13 of the head 3. As shown in FIG. 1, an outer diameter of a lower end of the upper part 7*a* is substantially equal to an outer diameter of the hosel end face 13. In the assembled state, the upper part 7*a* exhibits an appearance like a ferrule. In the assembled state, the intermediate part 7*b* and the lower part 7*c* are inserted into the hosel hole hz1. An outer surface of the intermediate part 7*b* includes a circumferential surface. The circumferential surface is brought into surface contact with an inner surface of the hosel hole hz1. The hosel hole hz1 supports the intermediate part 7*b* in the surface contact.

The lower part 7*c* of the sleeve 7 includes a rotation-preventing part rp1. A sectional shape of the rotation-preventing part rp1 is a non-circular form. In the embodiment, the rotation-preventing part rp1 includes a plurality of projections t1. The projections t1 are outwardly projected in the radial direction. The plurality of projections t1 are disposed at equal intervals in a circumferential direction (see FIG. 2).

The rotation-preventing part rp1 is engaged with a rotation-preventing part (not shown) provided on the head 3. Although not shown in the drawings, a plurality of recesses are formed in the rotation-preventing part of the head 3. The plurality of recesses are disposed at equal intervals in the circumferential direction. A shape of the recess corresponds to a shape of the projection t1 described above. Each of the projections t1 is engaged with the corresponding recess. The relative rotation of the head 3 and the sleeve 7 is prevented by the engagement.

As shown in FIG. 3, a center axis line h1 of the shaft hole 7*d* is inclined to a center axis line z1 of the sleeve 7. An angle θ1 shown in FIG. 3 is an angle between the axis line h1 and the axis line z1. An axis line s1 of the shaft 5 is inclined to an axis line e1 of the hosel hole due to the inclination of the center axis line h1. The inclination angle is also θ1.

The sleeve 7 can be fixed to the head 3 at a plurality of circumferential positions. The direction of the axis line s1 of the shaft 5 to the head 3 can be varied depending on the plurality of circumferential positions and the angle θ1. A face angle, a lie angle, and a real loft angle can be varied by the circumferential position of the sleeve 7. The face angle, the lie angle, and the real loft angle can be adjusted by selecting the circumferential position of the sleeve 7. In the adjustment, the face angle, the lie angle, and the real loft angle are interlocked with each other.

The prevention of coming off of the sleeve 7 is achieved by screw connection of the sleeve 7 and the screw 9. In the assembled state, the screw 9 is inserted into the through hole th1, and connected to the screw hole 7*e* of the sleeve 7 in a screwing manner. In the assembled state, a head part of the screw 9 cannot pass through the through hole th1. The head part of the screw 9 abuts on a lower surface f1 (see FIG. 6) of the head 3 with the washer 11 interposed between the head part and the lower surface f1. The screw 9 produces an axial force in the abutment. The bump surface ds1 is pressed against the hosel end face 13 by the axial force. The movement of the sleeve 7 upward in an axial direction is restricted by the axial force. The fixation of the sleeve 7 in the axial direction is maintained by the screw 9.

As shown in FIG. 6, the head 3 includes a grounding member Y1 and a movement restricting member Y2. In the embodiment, the movement restricting member Y2 is a screw body 15. A center axis line of the screw body 15 is a straight line.

As shown in FIG. 7, the screw body 15 includes a first non-screw part 15*a*, a second non-screw part 15*b*, a male screw part 15*c*, and a come-off preventing part 15*d*. The first non-screw part 15*a* is one end part of the screw body 15. The first non-screw part 15*a* is a cylinder. The second non-screw part 15*b* is the other end part of the screw body 15. The second non-screw part 15*b* is a cylinder. The male screw part 15*c* is formed between the first non-screw part 15*a* and the second non-screw part 15*b*. The come-off preventing part 15*d* is a flange. The come-off preventing part 15*d* is formed between the first non-screw part 15*a* and the male screw part 15*c*.

Figure 8:
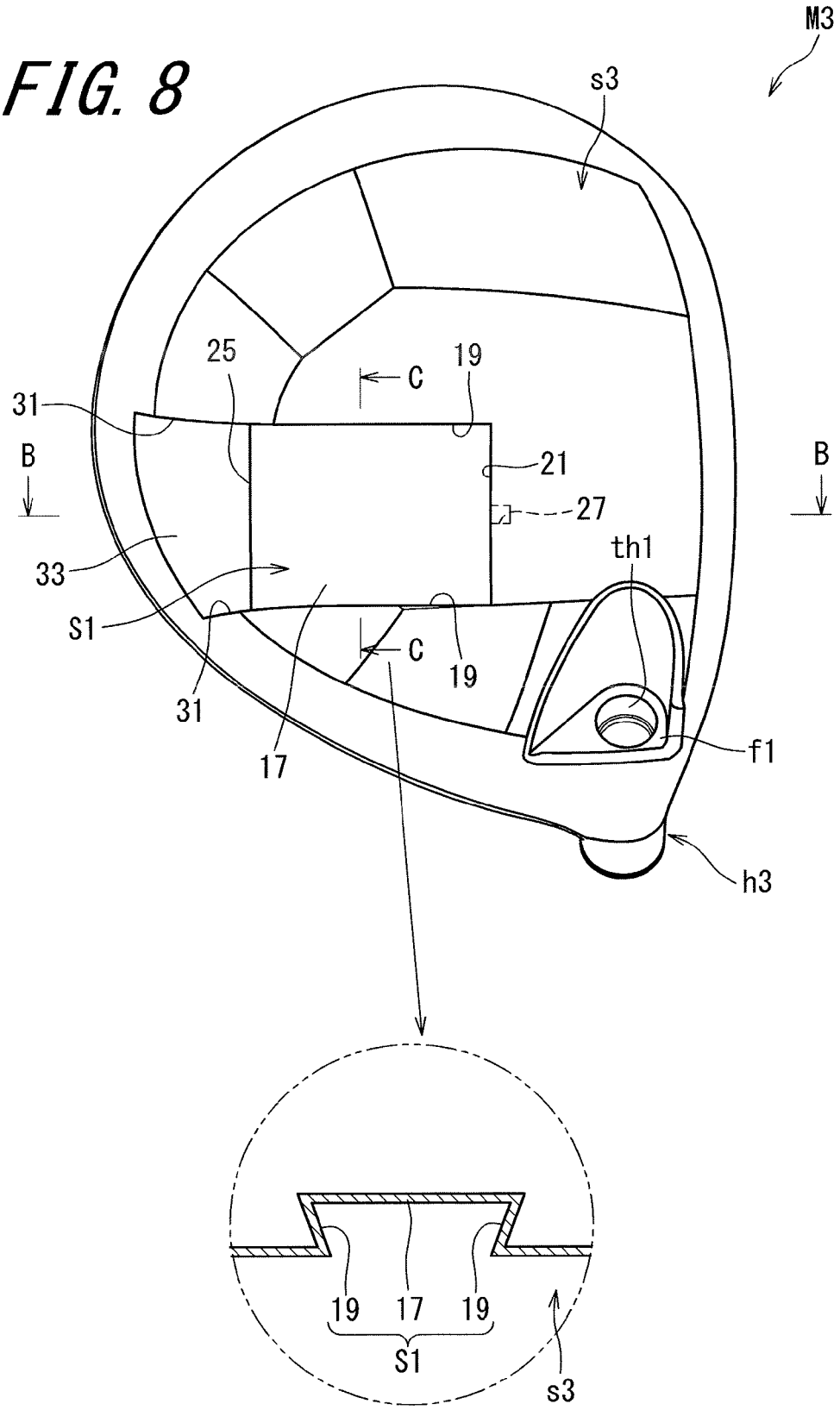
FIG. 8 is a bottom view of a head body.
Figure 9:
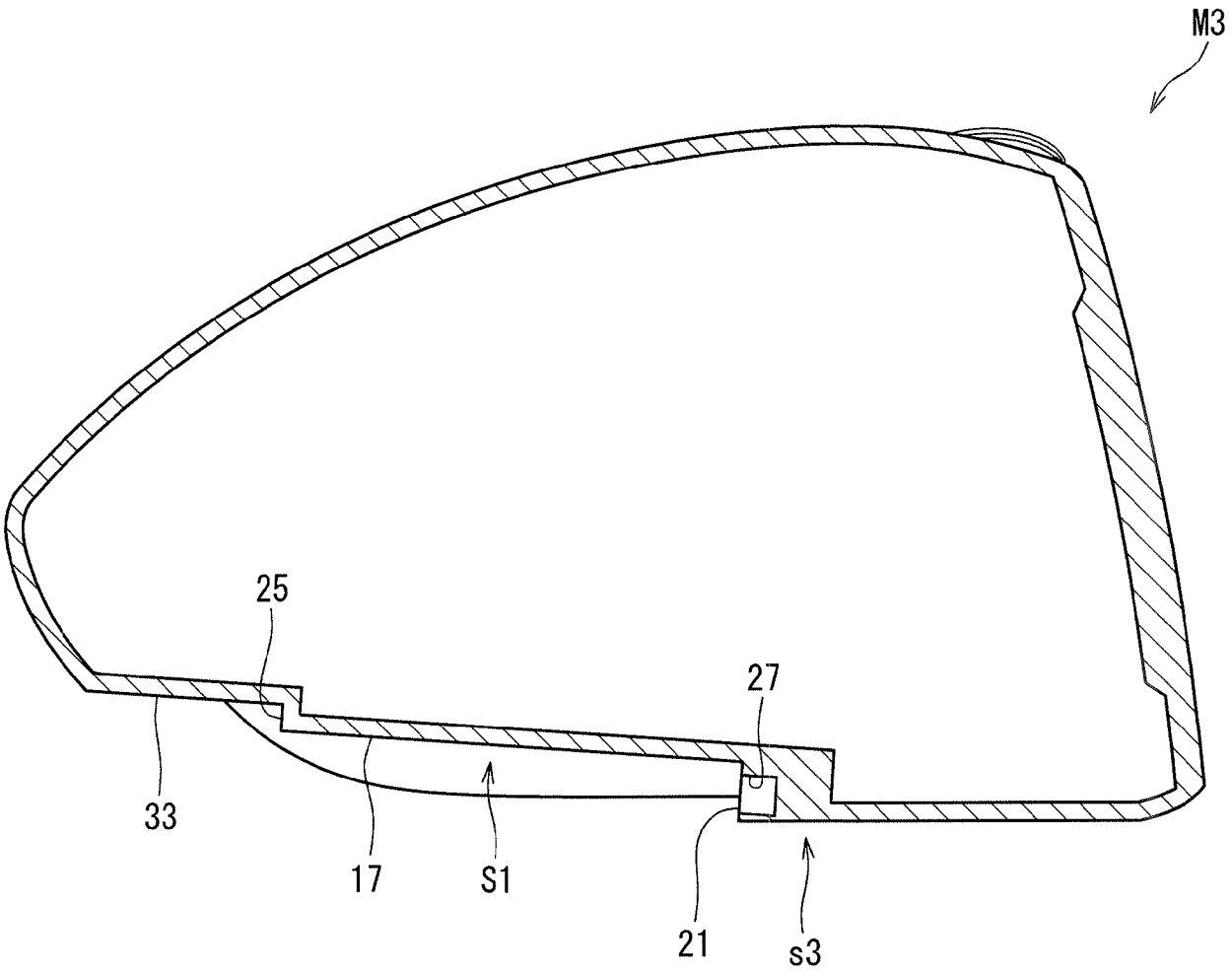
FIG. 9 is a cross-sectional view taken along line B-B of FIG. 8.

FIG. 8 is a bottom view of the head body M3. FIG. 9 is a cross-sectional view taken along line B-B of FIG. 8. An enlarged cross-sectional view taken along line C-C of FIG. 8 is shown in a circle of FIG. 8.

As shown in FIG. 8, the body M3 includes a slide part S1. The slide part S1 forms a slide groove. The slide part S1 has a slide bottom face 17, a slide side surface 19, and a slide end face 21. The slide side surface 19 is provided on each of a toe side and a heel side.

As shown in FIG. 6, the body M3 includes a supporting member 23. The supporting member 23 is fixed to the body M3. Examples of the fixing method include welding, bonding, press fitting, and screwing.

As shown in FIG. 9, the body M3 includes a bump surface 25. As shown in FIG. 7, an end face (a front surface 23*e* to be described later) of the supporting member 23 abuts on the bump surface 25. The positioning of the supporting member 23 is achieved by the bump surface 25.

As shown in FIG. 9, the body M3 has a supporting recess 27. The supporting recess 27 is formed in the slide end face 21. The supporting recess 27 rotatably holds the second non-screw part 15*b*.

In the embodiment, the grounding member Y1 is a slide body 29 that can slidingly move with the rotation of the screw body 15.

Figure 10A:
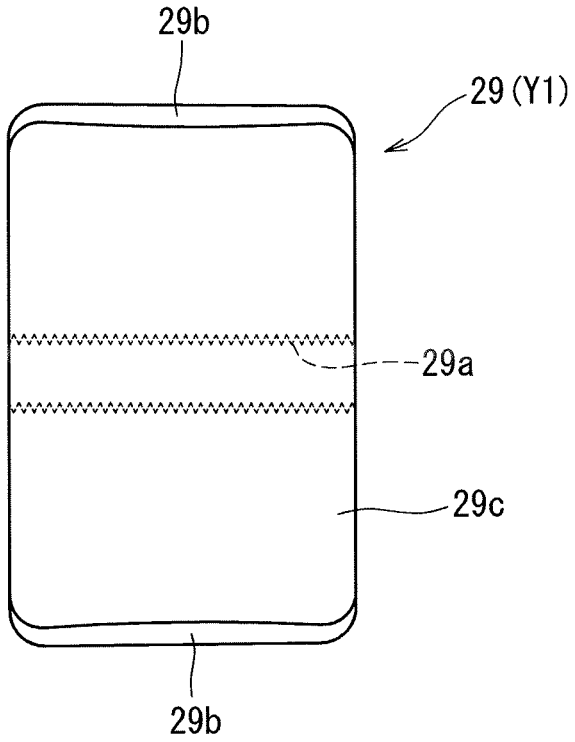
FIG. 10A is a plan view of a slide body (grounding member)
Figure 10B:
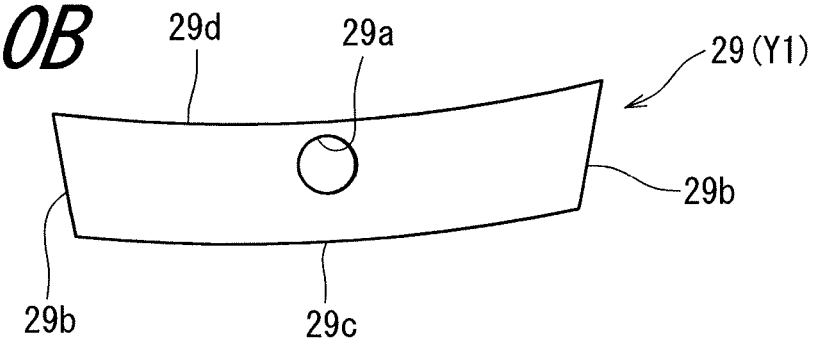
FIG. 10B is a side view of the slide body.
Figure 10C:
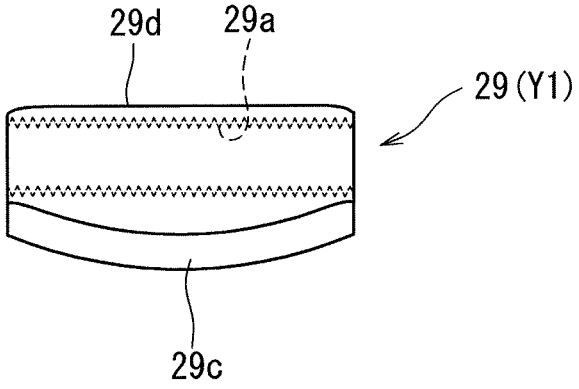
FIG. 10C is a front view of the slide body.

FIG. 10A is a bottom view of the slide body 29 (grounding member Y1). FIG. 10B is a side view of the slide body 29. FIG. 10C is a front view of the slide body 29.

The slide body 29 includes a screw hole 29*a*, a side surface 29*b*, a grounding surface 29*c*, and an upper surface 29*d*. The side surface 29*b* is provided on each of a toe side and a heel side. The screw hole 29*a* is a female screw. The screw body 15 passes through the screw hole 29*a*. The screw hole 29*a* is connected to the screw body 15 in a screwing manner. Each of the side surfaces 29*b* is brought into contact with each of the slide side surfaces 19. The upper surface 29*d* is brought into contact with the slide bottom face 17. The slide body 29 is held while being positioned, by the screw body 15.

The slide body 29 is slidably inserted into the slide part S1. As shown in the enlarged cross-sectional view of FIG. 8, each of both the slide side surfaces 19 has an inclination. The inclination forms an undercut. The side surface 29*b* of the slide body 29 also has an inclination corresponding to the inclination of the slide side surface 19. The slide body 29 is inserted into the slide part S1 from a backward of the head 3. If the slide body 29 slides, the side surface 29*b* and the slide side surface 19 slide with each other. The undercut of both the slide side surfaces 19 prevents the disengagement of the slide body 29. The undercut may not be present. The slide body 29 is held also by the screw body 15.

Figure 11A:
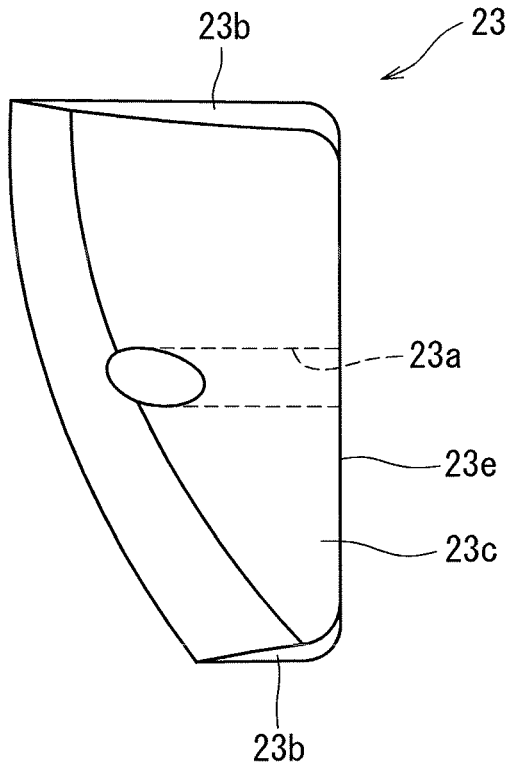
FIG. 11A is a bottom view of a supporting member.
Figure 11B:
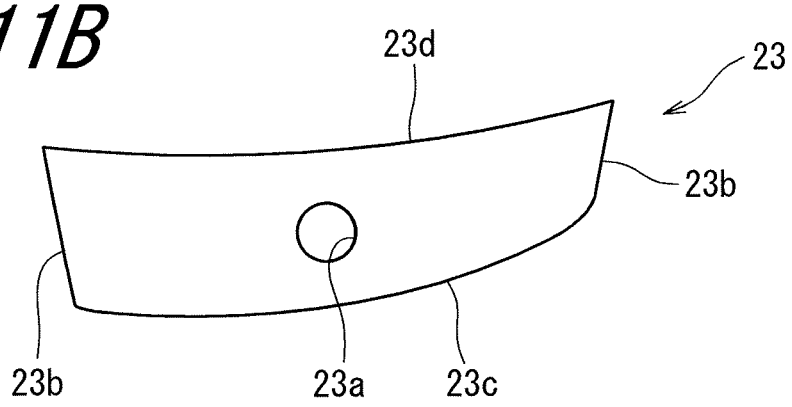
FIG. 11B is a front view of the supporting member.

FIG. 11A is a bottom view of the supporting member 23. FIG. 11B is a front view of the supporting member 23. The supporting member 23 includes a through hole 23*a*, a side surface 23*b*, a lower surface 23*c*, an upper surface 23*d*, and a front surface 23*e*.

Each of both the side surfaces 23*b* abuts on a bump surface 31 (see FIG. 8) of the body M3. The front surface 23*e* abuts on the bump surface 25. The side surface 23*b* abuts on a bottom face 33 (see FIG. 8) of the body M3. The supporting member 23 is positioned with high precision by these abutments.

As shown in FIG. 7, the first non-screw part 15*a* of the screw body 15 is rotatably supported by the supporting member 23. The first non-screw part 15*a* is inserted into the through hole 23*a*. The first non-screw part 15*a* is rotatably supported by the through hole 23*a*. Meanwhile, the second non-screw part 15*b* is rotatably supported by the supporting recess 27.

A typical method for assembling the head 3 is as follows. First, the screw body 15 is screwed into the screw hole 29*a* of the slide body 29. Next, the second non-screw part 15*b* is inserted into the supporting recess 27. Next, the first non-screw part 15*a* is inserted into the through hole 23*a*. Finally, the supporting member 23 is fixed to the body M3.

As shown in FIG. 7, the come-off preventing part 15*d* abuts on the front surface 23*e* of the supporting member 23. The coming off preventing part 15*d* restricts the movement of the screw body 15 backward in the axial direction. The come-off preventing part 15*d* may not be present. A screw thread of the male screw part 15*c* may function as the come-off preventing part.

The screw body 15 is axially rotated, and thereby the slide body 29 moves. The axial rotation of the screw body 15 can be achieved by an exclusive tool, for example. An end part of the first non-screw part 15*a* preferably has a form capable of facilitating the axial rotation of the screw body 15. Examples of the form capable of facilitating the axial rotation include a non-circular outer shape, a non-circular recess, and a groove. In the embodiment, the end part of the first non-screw part 15*a* has a non-circular outer shape (an outer shape having a hexagonal section).

In a face angle measurement state to be described later, the slide body 29 (grounding member Y1) is brought into contact with a level surface HP. The face angle is varied depending on the position of the slide body 29.

The position of the slide body 29 can be steplessly adjusted in a slidingly movable range. Therefore, the face angle can be finely adjusted.

Figure 12A:
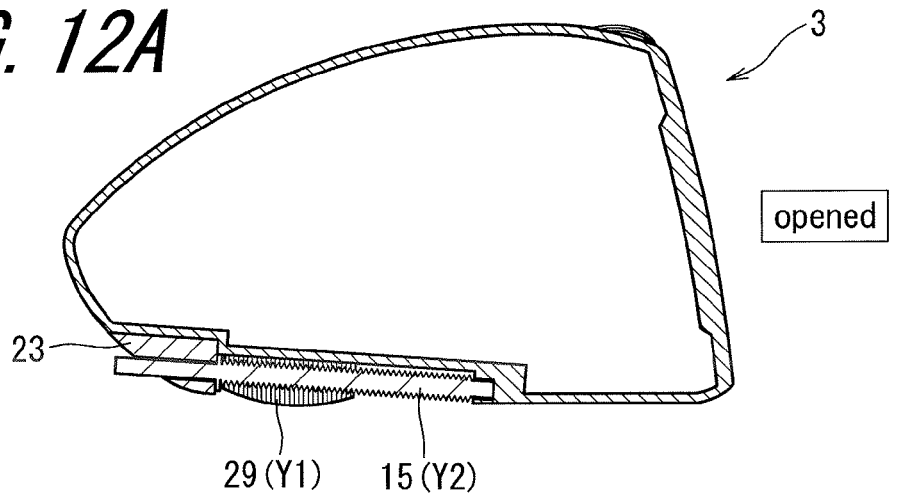
FIGS. 12A, 12B and 12C describe a method for adjusting a face angle in the first embodiment.
Figure 12B:
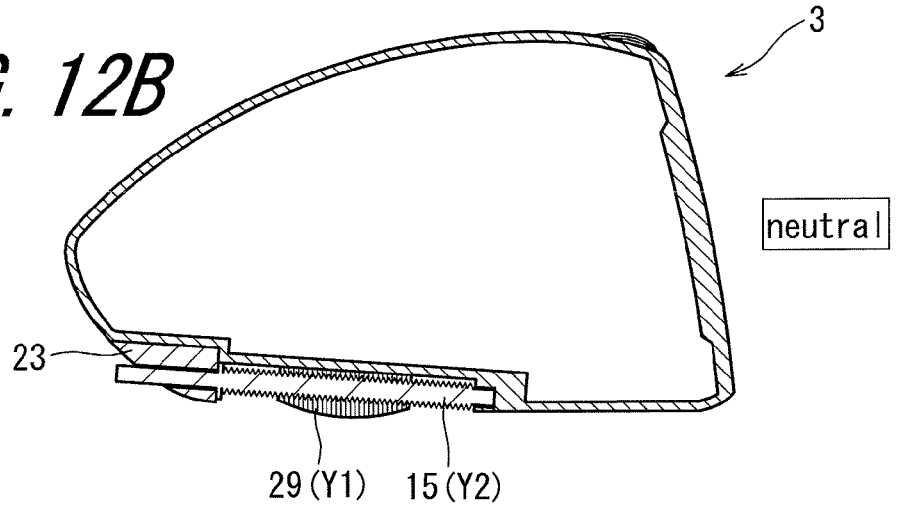
Figure 12C:
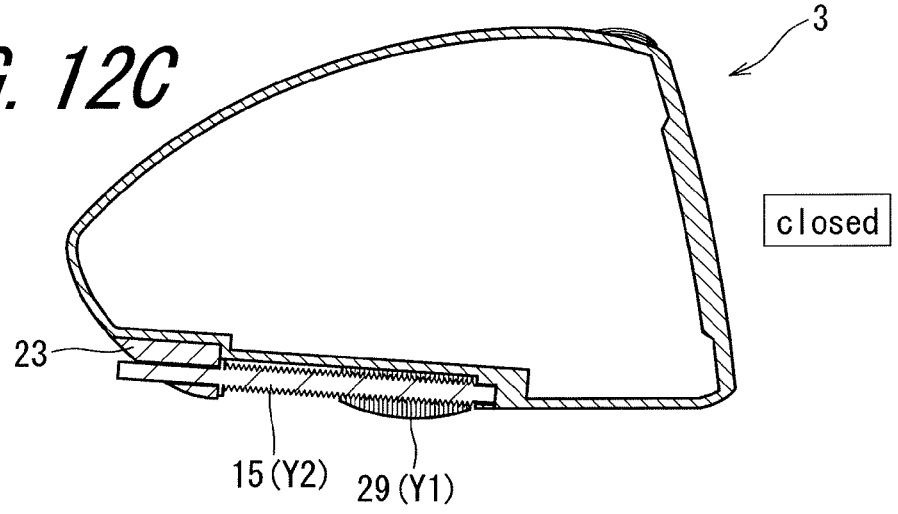

FIGS. 12A, 12B, and 12C are cross-sectional views for describing the adjustment of the face angle. As described above, in the embodiment, the face angle is steplessly adjusted. Three states shown in FIGS. 12A, 12B, and 12C are exemplified.

In FIG. 12A, the slide body 29 is positioned on the most back side. In FIG. 12C, the slide body 29 is positioned on the most face side. In FIG. 12B, the slide body 29 is positioned at the intermediate position.

In FIG. 12A, the face angle is opened as compared with the face angle in FIG. 12B. If the sole s3 is grounded to address the golf club, the face of the head of FIG. 12A is apt to turn to the right as compared with the face of the head of FIG. 12B. The face angle in FIG. 12C is closed as compared with the face angle in FIG. 12B. If the sole s3 is grounded to address the golf club, the face of the head of FIG. 12C is apt to turn to the left as compared with the face of the head of FIG. 12B.

Thus, the face angle can be varied depending on the position of the slide body 29 (grounding member Y1). In the embodiment, as the slide body 29 (grounding member Y1) is positioned on the back side, the face angle is opened. In other words, as the slide body 29 (grounding member Y1) moves to the face side, the face angle is closed. In the embodiment, the movement direction of the slide body 29 (grounding member Y1) is a face-back direction. The slide body 29 (grounding member Y1) can be fixed at a plurality of slide positions. The plurality of slide positions include a plurality of positions in the face-back direction.

The slide body 29 has a mass. The center of gravity of the head 3 moves with the movement of the slide body 29. In the embodiment, the following relationship A can be achieved.

[Relationship A]: As the face angle is opened, the center of gravity of the head is positioned on the back side.

If the face is opened in impact, a slice is apt to be generated. Meanwhile, as the center of gravity of the head is positioned on the back side, an angle of the center of gravity is apt to be large. As is well known, if the angle of the center of gravity is large, the face is apt to be returned in impact. If the relationship A is realized, an excessive slice can be suppressed by the canceling between the face angle and the angle of the center of gravity.

The slide body 29 (grounding member Y1) and the screw body 15 (movement restricting member Y2) provided on the sole s3 can lower the center of gravity of the head. The head having a low center of gravity can realize a high launch angle and small backspin. The head having a low center of gravity can contribute to an increase in a flight distance.

Thus, in the embodiment, the weight distribution of the head can be adjusted in addition to the adjustment of the face angle. Therefore, the above synergistic effect can be exhibited.

Figure 13:
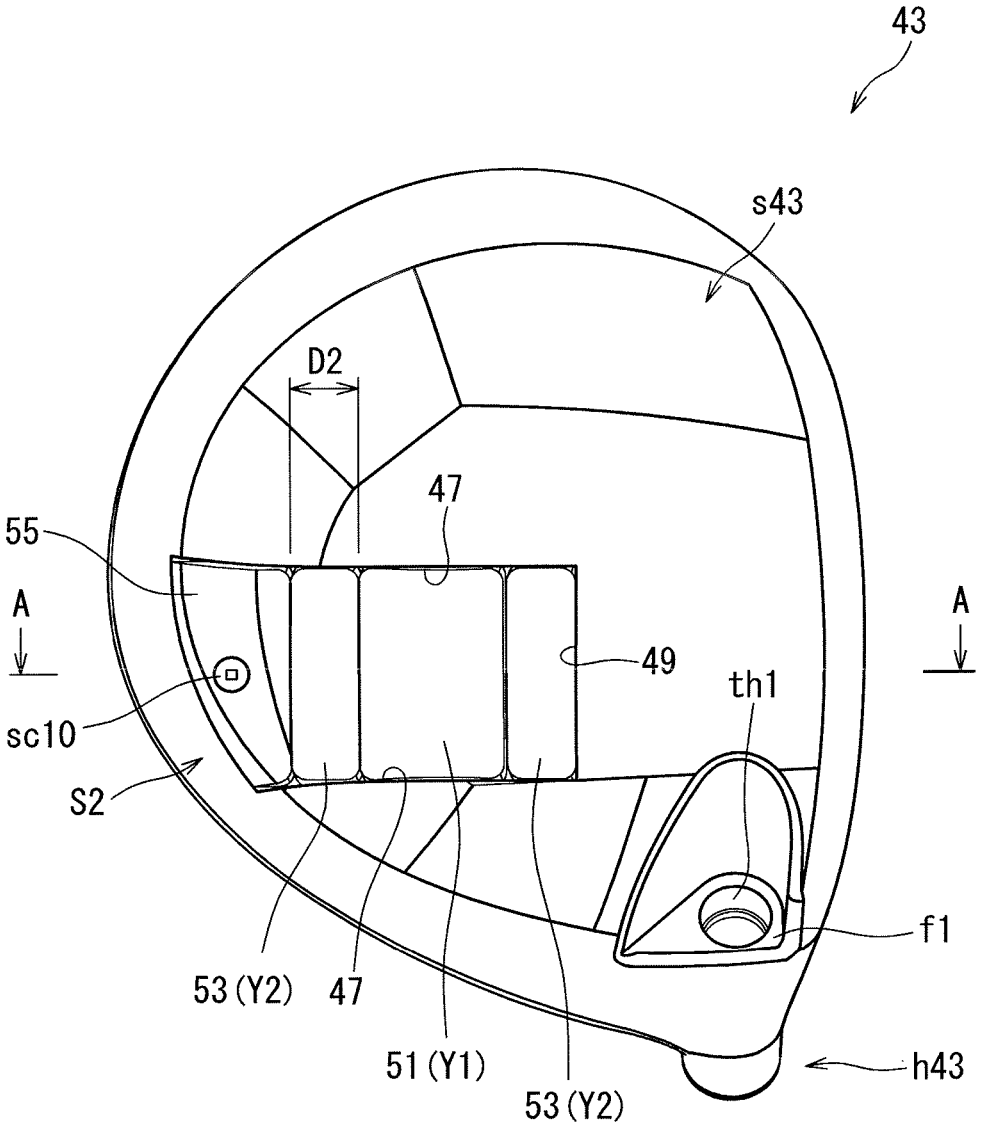
FIG. 13 is a bottom view of a head according to a second embodiment.
Figure 14:
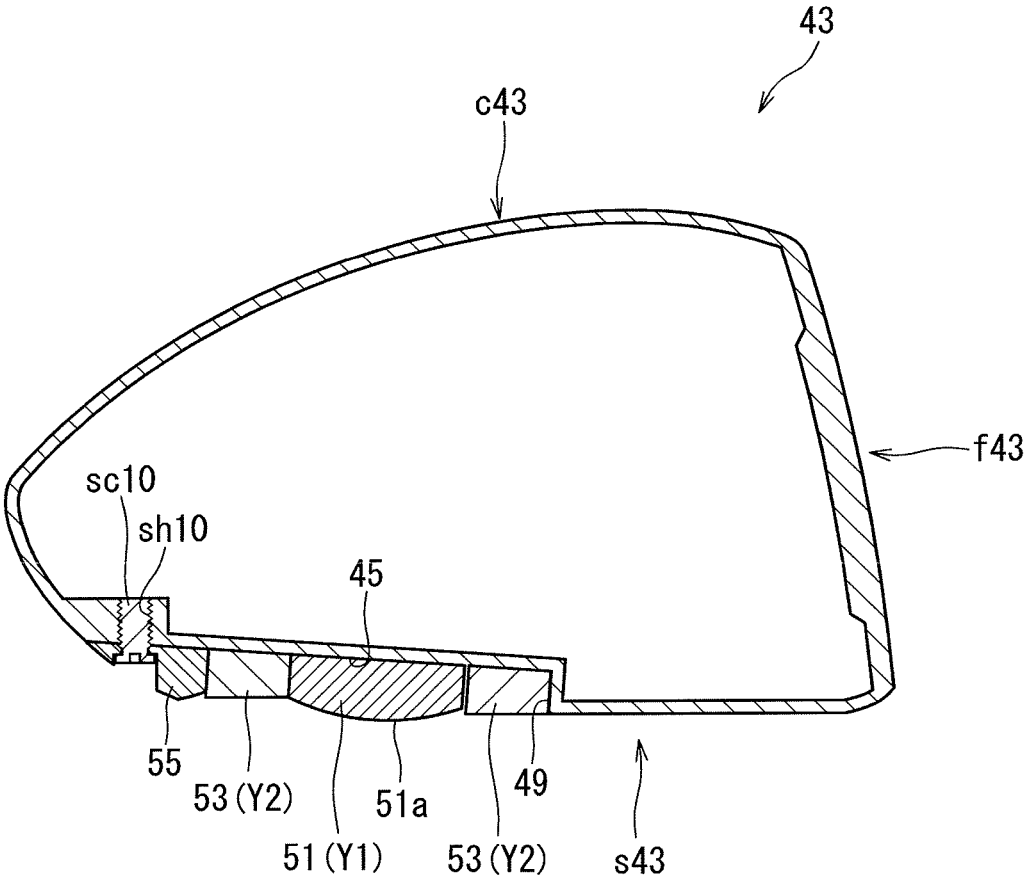
FIG. 14 is a cross-sectional view taken along line A-A of FIG. 13.
Figure 15:
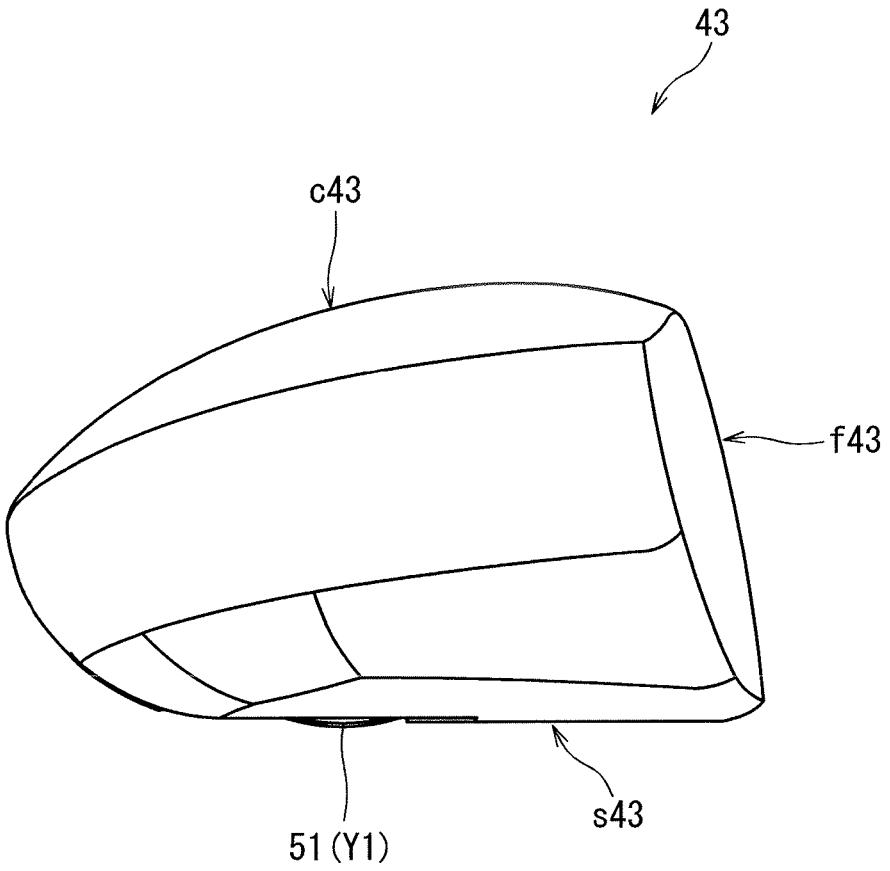
FIG. 15 is a side view of a head of FIG. 13.
Figure 16:
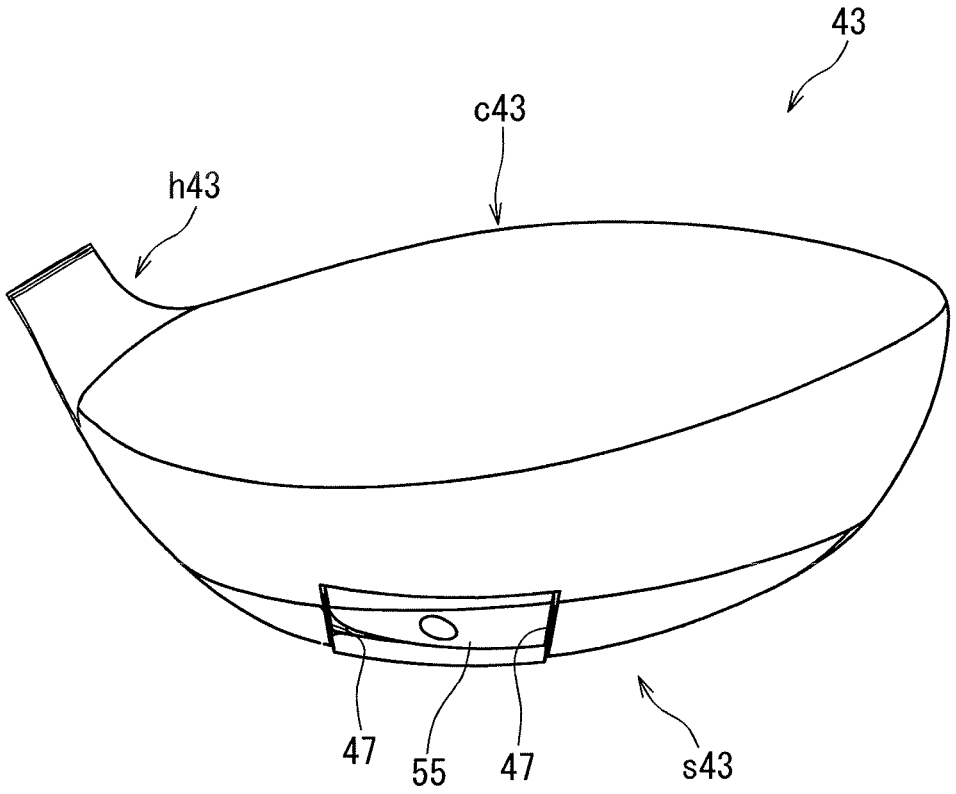
FIG. 16 is a back view of the head of FIG. 13.

FIG. 13 is a bottom view of a head 43 according to a second embodiment of the present invention. FIG. 14 is a cross-sectional view taken along line A-A of FIG. 13. FIG. 15 is a side view of the head 43. FIG. 16 is a back view of the head 43. The shaft 5, the sleeve 7, and the screw 9 of the first embodiment described above can be attached to the head 43.

The head 43 includes a body M43. As shown in FIGS. 13 to 16, the body M43 includes a crown c43, a sole s43, a face f43, and a hosel h43.

The head body M43 includes a slide part S2. The shape of the slide part S2 in the plan view is the same as the shape of the slide part S1 described above.

The slide part S2 forms a slide groove. The slide part S2 includes a slide bottom face 45 (see FIG. 14), a side surface 47 (see FIGS. 13 and 16), and a slide end face 49.

The side surface 47 is inclined as well as the slide side surface 19 of the slide part S1. An undercut is formed by both the side surfaces 47 (see FIG. 16).

As shown in FIGS. 13 and 14, the head 43 includes a grounding member Y1 and a movement restricting member Y2. In the embodiment, a plurality of movement restricting members Y2 are provided. In the embodiment, two movement restricting members Y2 are provided.

In the embodiment, the grounding member Y1 is a slide body 51. The slide body 51 is slidingly inserted into the slide part S2. Each of both side surfaces of the slide body 51 has an inclination corresponding to the above side surface 47. Therefore, the disengagement of the slide body 51 is prevented as well as the slide body 29 described above.

In the embodiment, the movement restricting member Y2 is a positioning member 53. A plurality of positioning members 53 are provided. As shown in FIGS. 13 and 14, two positioning members 53 are provided.

The positioning member 53 is slidingly inserted into the slide part S2. Each of both side surfaces of the positioning member 53 has an inclination corresponding to the side surface 47 as in the slide body 51. Therefore, the disengagement of the positioning member 53 is prevented as in the slide body 51 described above.

Thus, the slide body 51 and all of the positioning members 53 are slidably held by the slide part S2.

The head 43 includes a fixed member 55. The fixed member 55 is detachably attached to the head body M43. In the embodiment, the fixed member 55 is attached to the head body M43 by screwing. The fixed member 55 has a through hole for screwing. A screw sc10 is inserted into the through hole.

The head body M43 has a screw hole sh10. The screw hole sh10 forms a female screw. The fixed member 55 is fixed to the head body M43 by screw connection of the screw hole sh10 and the screw sc10.

The fixed member 55 closes a slide insertion opening of the slide part S2. If the fixed member 55 is attached to the body M43, the slide body 51 and the positioning member 53 cannot be taken out from the slide part S2.

The slide body 51 and the plurality (two) of positioning members 53 are slidingly inserted into the slide part S2. The slide body 51 and the plurality of positioning members 53 abut on each other. The disposing order of the slide body 51 and the positioning members 53 can be freely set. A member positioned on the most back side, among the slide body 51 and the two positioning members 53, abuts on the fixed member 55. The slide body 51 and the positioning members 53 are sandwiched between the slide end face 49 and the fixed member 55. The fixed member 55 prevents the slide movements of the slide body 51 and the plurality of positioning members 53.

A method for fixing the fixed member 55 is not limited. In respect of fixation certainty, fixation caused by mechanical connection is preferable. An example of the mechanical connection is the screw connection described above.

Other examples of the mechanical connection include an attaching/detaching mechanism described in Japanese Patent Application Laid-Open No. 2012-139403. In the attaching/detaching mechanism, a cavity body is attached to a head, and a weight is detachably attached to the cavity body. For example, the weight can be disposed near the insertion opening of the slide part S2. The weight can restrict the slide movements of the slide body 51 and the positioning members 53.

Figure 17A:
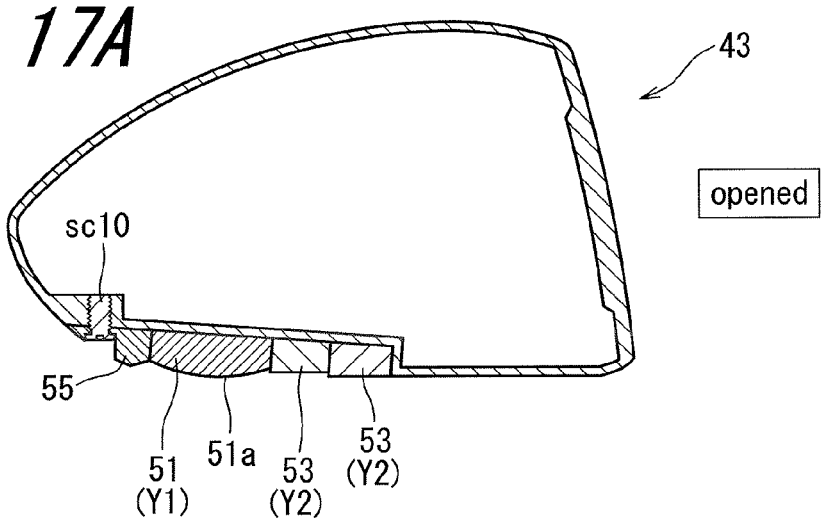
FIGS. 17A, 17B and 17C describe a method for adjusting a face angle in the second embodiment.
Figure 17B:
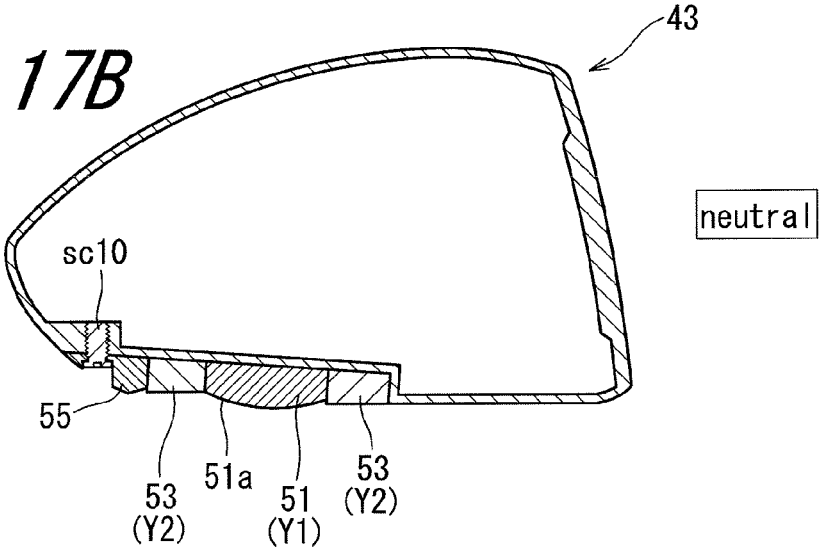
Figure 17C:
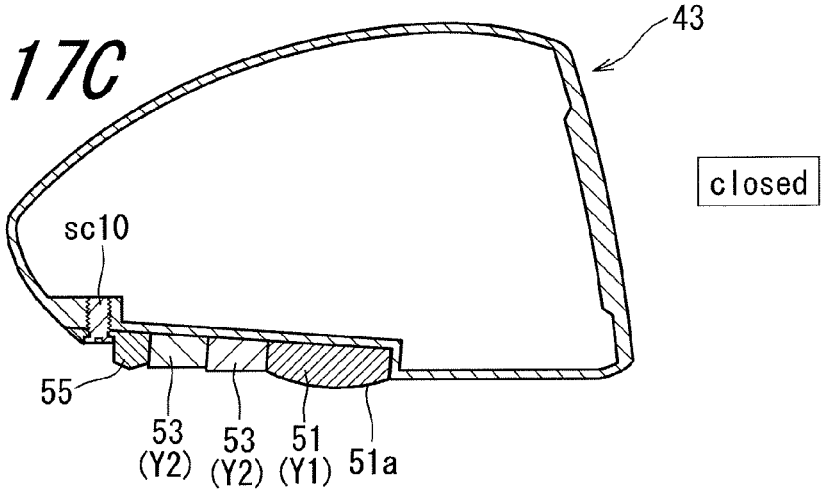

FIGS. 17A, 17B, and 17C are cross-sectional views for describing the adjustment of the face angle. In the embodiment, the face angle is adjusted in three stages.

In FIG. 17A, the slide body 51 is positioned on the most back side. In the embodiment of FIG. 17A, all (two) of the positioning members 53 are disposed on the face side of the slide body 51.

In FIG. 17C, the slide body 51 is positioned on the most face side. In the embodiment of FIG. 17C, all (two) of the positioning members 53 are disposed on the back side of the slide body 51.

In FIG. 17B, the slide body 51 is positioned at the intermediate position. In the embodiment of FIG. 17C, a first positioning member 53 is disposed on the back side of the slide body 51, and a second positioning member 53 is disposed on the face side of the slide body 51.

In a face angle measurement state to be described later, a grounding surface 51*a* of the slide body 51 is grounded on the level surface HP regardless of the position of the slide body 51.

The face angle in FIG. 17A is opened as compared with the face angle in FIG. 17B. If the sole s43 is grounded to address the golf club, the face of the head of FIG. 17A is apt to turn to the right as compared with the face of the head of FIG. 17B. The face angle in FIG. 17C is closed as compared with the face angle in FIG. 17B. If the sole s43 is grounded to address the golf club, the face of the head of FIG. 17C is apt to turn to the left as compared with the face of the head of FIG. 17B.

Thus, the face angle can be varied depending on the position of the slide body 51 (grounding member Y1). In the embodiment, as the slide body 51 (grounding member Y1) is positioned on the back side, the face angle is opened. In other words, as the slide body 51 (grounding member Y1) moves to the face side, the face angle is closed. In the embodiment, the movement direction of the slide body 51 (grounding member Y1) is the face-back direction. The slide body 51 (grounding member Y1) can be fixed at a plurality of slide positions. The plurality of slide positions includes a plurality of positions in the face-back direction.

In the adjustment of the face angle, the disposing order of the positioning member 53 and the slide body 51 is changed. A typical method for changing the disposing order is as follows. First, the fixed member 55 is removed. Next, the slide body 51 and the positioning member 53 are pulled out from the slide part S2. Next, the slide body 51 and the positioning member 53 are sequentially slidingly inserted into the slide part S2 so that a desired disposing order is set. Finally, the fixed member 55 is fixed.

The number of the sliding bodies 51 is defined as N1, and the number of the positioning members 53 is defined as N2. N1 is an integer equal to or greater than 1. N2 is an integer equal to or greater than 1. Preferably, N1 is 1. In light of the degree of freedom of adjustment of the face angle, N2 is preferably equal to or greater than 2. In respect of the easiness of the adjustment work of the face angle, N2 is preferably equal to or less than 4, and more preferably equal to or less than 3.

A width of the positioning member 53 in a slide direction is shown by a double-headed arrow D2 in FIG. 13. In the embodiment, in the plurality of positioning members 53, the widths D2 are the same. In the plurality of positioning members 53, the widths D2 may be different. In this case, the position of the slide body 51 that can be fixed can be increased without increasing the number N2 of the positioning members 53. Therefore, the degree of freedom of the adjustment of the face angle can be improved.

The positioning member 53 ensures the fixation of the slide body 51. Further, the positioning of the slide body 51 is achieved with high precision by the positioning member 53.

The positioning member 53 has a mass. The movement of the center of gravity of the head with the movement of the slide body 51 is suppressed by the positioning member 53. Therefore, the face angle can be adjusted while the movement of the center of gravity of the head is suppressed.

The weight of the slide body 51 is defined as Wa, and the total weight of the positioning members 53 is defined as Wb. In respect of suppressing the movement of the center of gravity of the head, the lower limit of a ratio (Wa/Wb) is preferably equal to or greater than 0.5, more preferably equal to or greater than 0.7, still more preferably equal to or greater than 0.8, and yet still more preferably equal to or greater than 0.9. The upper limit of the ratio (Wa/Wb) is preferably equal to or less than 1.5, more preferably equal to or less than 1.3, still more preferably equal to or less than 1.2, and yet still more preferably equal to or less than 1.1. If the plurality of positioning members 53 are present, the total weight Wb is the total weight of the plurality of positioning members 53.

Meanwhile, the position of the center of gravity of the head may be moved with the movement of the slide body 51. In this case, the weight of the positioning member 53 is preferably lighter or heavier than the weight of the slide body 51. In this respect, the ratio (Wa/Wb) is preferably less than 0.5, or, the ratio (Wa/Wb) is preferably greater than 1.5. If the ratio (Wa/Wb) is excessively large or small, the weight Wa or the weight Wb may be excessively large. The excessively large weight Wa or the excessively large weight Wb may decrease the degree of freedom of design of the head body M43. In this respect, if the ratio (Wa/Wb) is less than 0.5, the ratio (Wa/Wb) is preferably equal to or greater than 0.2, and more preferably equal to or greater than 0.3. In the same respect, the ratio (Wa/Wb) is preferably greater than 1.5, the ratio (Wa/Wb) is preferably equal to or less than 5, more preferably equal to or less than 4, and still more preferably equal to or less than 3.

Also in the embodiment, the above relationship A can be achieved.

The slide body 51 (grounding member Y1) and the positioning member 53 (movement restricting member Y2) can lower the center of gravity of the head. The head having a low center of gravity can realize a high launch angle and small backspin. The head having a low center of gravity can contribute to an increase in a flight distance. Thus, in the embodiment, the weight distribution of the head can be adjusted in addition to the adjustment of the face angle.

The adjustable range of the face angle is preferably large. However, the excessively closed face angle and the excessively opened face angle are usually unnecessary. In light of them, the lower limit of the adjustable range of the face angle is preferably equal to or greater than 2 degrees, and more preferably equal to or greater than 3 degrees. The upper limit of the adjustable range is preferably equal to or less than 10 degrees, more preferably equal to or less than 8 degrees, and still more preferably equal to or less than 6 degrees. For example, if the maximum value of the face angle is +1 degree, and the minimum value of the face angle is −1 degree, the adjustable range of the face angle is 2 degrees.

[Material of Grounding Member Y1 (Slide Body 29, Slide Body 51)]

The material of the grounding member Y1 is not limited. Preferable examples of the material include a metal, a resin, and a fiber-reinforced resin. In respect of a strength and durability, the metal is preferable. Examples of the metal include a titanium alloy, stainless steel, an aluminum alloy, a magnesium alloy, stainless steel, a tungsten-nickel alloy, and a tungsten alloy. Examples of the resin include an engineering plastic and a super-engineering plastic. Examples of the fiber-reinforced resin include CFRP (carbon fiber-reinforced plastic). If the movement of the center of gravity of the head is suppressed, a material having a small specific gravity is preferable. In this respect, the fiber-reinforced resin, the titanium alloy, the aluminum alloy, and the magnesium alloy are preferable, and the aluminum alloy is more preferable. If the movement of the center of gravity of the head is facilitated, a material having a large specific gravity and easily processed is preferable. In this respect, the stainless steel and the tungsten-nickel alloy are preferable.

[Material of Positioning Member 53]

The material of the positioning member 53 is not limited. Preferable examples of the material include a metal, a resin, and a fiber-reinforced resin. In respect of a strength and durability, the metal is preferable. Examples of the metal include a titanium alloy, stainless steel, an aluminum alloy, a magnesium alloy, stainless steel, a tungsten-nickel alloy, and a tungsten alloy. Examples of the resin include an engineering plastic and a super-engineering plastic. Examples of the fiber-reinforced resin include CFRP (carbon fiber-reinforced plastic). If the movement of the center of gravity of the head is suppressed, a material having a small specific gravity is preferable. In this respect, the fiber-reinforced resin, the titanium alloy, the aluminum alloy, and the magnesium alloy are preferable, and the aluminum alloy is more preferable. If the movement of the center of gravity of the head is facilitated, a material having a large specific gravity and easily processed is preferable. In this respect, the stainless steel and the tungsten-nickel alloy are preferable.

The specific gravity of the head body M3 is defined as G1, and the specific gravity of the grounding member Y1 is defined as G2. In respect of suppressing the movement of the center of gravity of the head caused by the adjustment of the face angle, the specific gravity G2 is preferably equal to or less than the specific gravity G1, and the specific gravity G2 is more preferably less than the specific gravity G1.

The specific gravity of the positioning member 53 is defined as G3. In respect of suppressing the movement of the center of gravity of the head caused by the adjustment of the face angle, the specific gravity G3 is preferably equal to or less than the specific gravity G1, and the specific gravity G3 is more preferably less than the specific gravity G1.

A method for manufacturing the grounding member Y1 (slide body 29, slide body 51) is not limited. Examples of the method include forging, sintering, casting, die-casting, NC processing, press forming, and injection forming. A method for manufacturing the positioning member 53 is not limited. Examples of the method include forging, sintering, casting, die-casting, NC processing, press forming, and injection forming.

[Method for Measuring Face Angle]

In the measurement of the face angle, the golf club 1 is placed on the level surface HP at a specified lie angle. The axis line s1 of the shaft is disposed in a plane VP perpendicular to the level surface HP. The shaft 5 is supported in a state where the lie angle is held, the shaft 5 can be moved in the direction of the axis line s1, and the shaft 5 can be rotated around the axis line s1. The sole s3 is grounded on the level surface HP so that the head 3 is most stable while the support of the shaft 5 is maintained. The state where the head 3 is most stable is also referred to as a face angle measurement state. In the face angle measurement state, the face angle is measured. In FIG. 4, a straight line LF shown by a chain double-dashed line is a tangent line brought into contact with the face f3 in a center point FC of the face f3. The tangent line LF is parallel to the level surface HP. The face angle is measured based on the tangent line LF. If a line of intersection between the level surface HP and the plane VP is defined as LK, an angle θ between the line of intersection LK and the tangent line LF is the face angle. The angle θ is measured in the plan view. The face angle can be measured by a measuring apparatus shown in FIG. 14 in Japanese Patent Application Laid-Open No.

2004-267460. In Japanese Patent Application Laid-Open No. 2004-267460, the face angle in the present application is referred to as a hook angle.

The center point FC of the face f3 is defined as the center of a figure of the face f3 in the plan view.

In the case of a driver (No. 1 wood), the specified lie angle is usually 56 degrees or greater and 60 degrees or less. The real loft angle of the driver is usually 8 degrees or greater and 13 degrees or less. The club length of the driver is usually 43 inches or greater and 48 inches or less. The club length is measured based on the golf rule of "1c. Length" in "1. Clubs" of "Appendix II. Design of Clubs" specified by R&A (Royal and Ancient Golf club of Saint Andrews).

In the present application, the direction of the line of intersection LK is defined as a toe-heel direction. The direction perpendicular to the toe-heel direction and parallel to the level surface HP is defined as a face-back direction.

In the present application, a plus or minus sign is applied to the value of the face angle (see FIG. 4). If the face f3 is closed to the line of intersection LK, the face angle is described as a plus value. If the face f3 is opened to the line of intersection LK, the face angle is described as a minus value. In the state shown in FIG. 4, the face f3 is opened, and the face angle is a minus value.

EXAMPLES

Hereinafter, the effects of the present invention will be clarified by Examples. However, the present invention should not be interpreted in a limited way based on the description of the Examples.

Example A

The same golf club as the golf club 1 described above was produced. A head was the same as the head 3 described above. First, a first member (face member) was obtained by pressing a rolling material. A second member (body) was obtained by lost-wax precision casting. The second member had a sole having a slide part S1 provided thereon. The first member and the second member were welded, to obtain a head body M3. Separately, a slide body 29 was produced. An aluminum alloy was used as the material of the slide body 29. As described above, the body M3, a screw body 15, a supporting member 23, and the slide body 29 were assembled, to obtain the head. The supporting member 23 was welded to the body M3. An titanium alloy was used as the material of the body M3 and the supporting member 23.

A shaft, a sleeve, a washer, a screw, and a grip were produced by a well-known method. An aluminum alloy was used as the material of the sleeve. A titanium alloy was used as the material of the screw. The sleeve was bonded to the tip part of the shaft, to obtain a shaft sleeve member. The shaft sleeve member was screwed to the head. The grip was attached to the back end of the shaft, to obtain the golf club. The specified lie angle of the head was 58 degrees.

The screw body 15 was axially rotated, to slidingly move the slide body 29. As shown in FIG. 12A, if the slide body 29 was positioned on the most back side, the face angle was −2 degrees. As shown in FIG. 12B, if the slide body 29 was positioned in the center of a movable range, the face angle was 0 degree. As shown in FIG. 12C, if the slide body 29 was positioned on the most face side, the face angle was +2 degrees.

Example B

Figure 18:
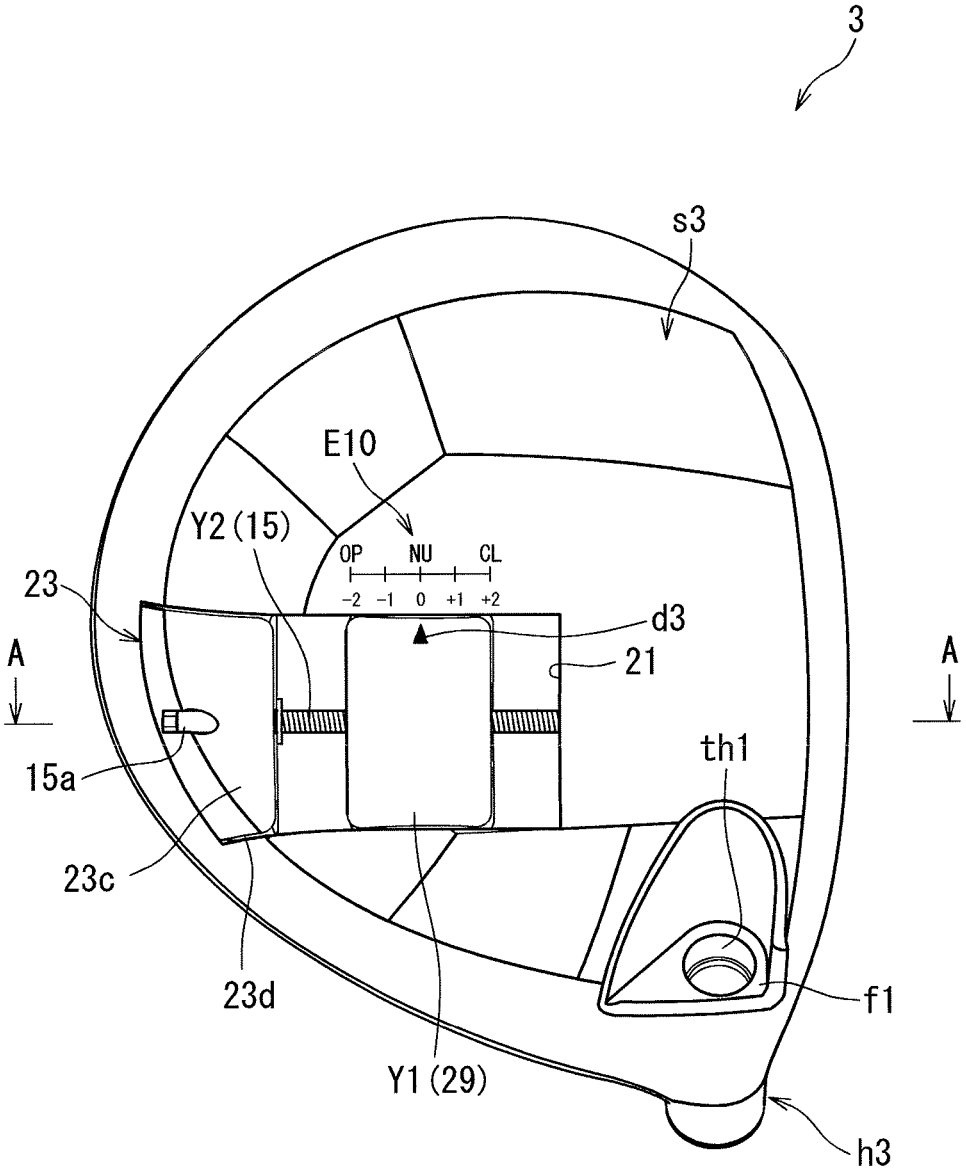
FIG. 18 is a bottom view of a head according to Example B.

A golf club of Example B was obtained in the same manner as in Example A except that indications were provided on a slide body 29 and a sole s3. FIG. 18 was a bottom view of a head according to Example B. In Example B, an indication part d3 was provided on the slide body 29 (grounding member Y1). The indication part d3 of the embodiment had a substantially triangle shape. The position of the slide body 29 was easily recognized based on the indication part d3.

Meanwhile, a sole indication part E10 was provided on the sole s3. Scales and characters were provided on the sole indication part E10. For example, the sole indication part E10 may be the characters, signs, or the scales. In Example B, the characters were alphabets and numerical values.

The sole indication part E10 included indications capable of showing the state of the face angle. In the sole indication part E10, a character "OP" stands for "OPENED". In the sole indication part E10, a character "NU" stands for "NEUTRAL". In the sole indication part E10, a character "CL" stands for "CLOSED". The face angle was shown by the positional relationship between the sole indication part E10 and the indication part d3.

The sole indication part E10 included indications capable of showing the value of the face angle. In the sole indication part E10, a character "+2" showed that the face angle was +2 degrees. If the indication part d3 pointed "+2", the face angle was +2 degrees. In the sole indication part E10, a character "+1" showed that the face angle was +1 degree. If the indication part d3 pointed "+1", the face angle was +1 degree. A character "0" showed that the face angle was 0 degree. If the indication part d3 pointed "0", the face angle was 0 degree. A character "−1" showed that the face angle was −1 degree. If the indication part d3 pointed "−1", the face angle was −1 degree. A character "−2" showed that the face angle was −2 degree. If the indication part d3 pointed "−2", the face angle was −2 degrees.

Example C

A golf club of Example C was obtained in the same manner as in Example A except that a head was changed to the head 43 described above. First, a first member (face member) was obtained by pressing a rolling material. A second member (body) was obtained by lost-wax precision casting. The second member had a sole having a slide part S2 provided thereon. As described above, two positioning members 53 and a slide body 51 were slidingly inserted into a slide part S2, and a fixed member 55 was screwed, to obtain the head. An aluminum alloy was used as the material of the slide body 51 and the positioning member 53.

The disposing order of the two positioning members 53 and the slide body 51 was changed, and the slide body 51 was moved. As shown in FIG. 17A, when the slide body 51 was positioned on the most back side, a face angle was −2 degrees. As shown in FIG. 17B, if the slide body 51 was positioned at the intermediate position, the face angle was 0 degree. As shown in FIG. 17C, when the slide body 51 was positioned on the most face side, the face angle was +2 degrees.

Example D

Figure 19:
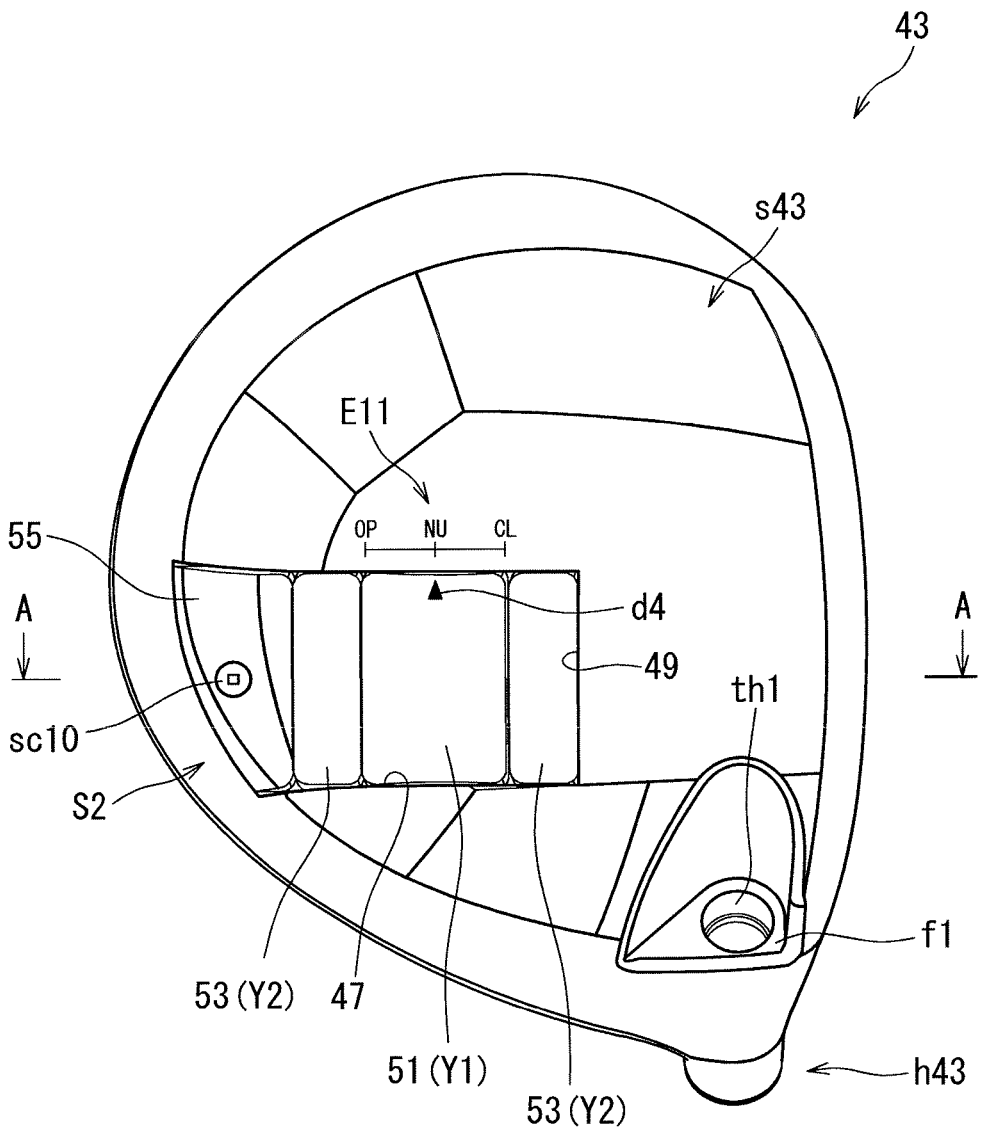
FIG. 19 is a bottom view of a head according to Example D.

A golf club of Example D was obtained in the same manner as in Example C except that indication parts were provided on a slide body 51 and a sole s43. FIG. 19 is a bottom view of a head according to Example D. In Example D, an indication part d4 was provided on the slide body 51 (grounding member Y1). The indication part d4 of the embodiment had a substantially triangle shape. The position of slide body 51 is easily recognized based on the indication part d4.

Meanwhile, a sole indication part E11 was provided on the sole s43. Scales and characters were provided on the sole indication part E11. For example, the sole indication part E11 may be the characters, the signs, or the scales. In Example D, the characters were alphabets.

The sole indication part E11 was an indication capable of showing the state of the face angle. In the sole indication part E11, a character "OP" stands for "OPENED". In the sole indication part E11, a character "NU" stands for "NEUTRAL". In the sole indication part E11, a character "CL" stands for "CLOSED". The face angle was shown by the positional relationship between the sole indication part E11 and the indication part d4.

Thus, in Examples, the face angle is easily adjusted. The sliding direction of the grounding member Y1 can be freely set. Therefore, the degree of freedom of the adjustment of the face angle is high. The center of gravity of the head can also be adjusted if needed. The advantages of the present invention are apparent.

The invention described above can be applied to all golf club heads.

The description hereinabove is merely for an illustrative example, and various modifications can be made in the scope not to depart from the principles of the present invention.

What is claimed is:

1. A golf club comprising:

a head; and a shaft, wherein the head comprises a head body, a grounding member, and a movement restricting member;

the head body comprises a sole;

the sole comprises a straight slide part that can slide the grounding member in a front to back direction where a face is located at the front;

the movement restricting member restricts slide movement of the grounding member while allowing the grounding member to be fixed at a plurality of slide positions; and a face angle can be varied depending on the plurality of slide positions of the grounding member.

2. The golf club according to claim 1, wherein the movement restricting member comprises at least one positioning member that can slidingly move in the slide part, and a fixed member detachably attached to the head body; and the slide position of the grounding member is changed by a disposing order of the positioning member and the grounding member; and the slide movements of the positioning member and the grounding member are restricted by the fixed member.

3. The golf club according to claim 2, wherein if a specific gravity of the head body is defined as G1, a specific gravity of the grounding member is defined as G2, and a specific gravity of the positioning member is defined as G3; the specific gravity G2 is equal to or less than the specific gravity G1 and the specific gravity G3 is equal to or less than the gravity G1.

4. The golf club according to claim 2, wherein the plurality of positioning members are provided; and the positioning members have widths different from each other.

5. The golf club according to claim 2, wherein if a weight of the grounding member is defined as Wa and a total weight of the one or more positioning members is defined as Wb, Wa/Wb is 0.5 or greater and 1.5 or less.

6. The golf club according to claim 2, wherein if a weight of the grounding member is defined as Wa and a total weight of the one or more positioning members is defined as Wb, Wa/Wb is 0.2 or greater and less than 0.5.

7. The golf club according to claim 2, wherein if a weight of the grounding member is defined as Wa and a total weight of the one or more positioning members is defined as Wb, Wa/Wb is greater than 1.5 and 5 or less.

8. The golf club according to claim 1, wherein the movement restricting member is a screw body axially rotatably supported by the sole;

the grounding member is connected to the screw body in a screwing manner; and the slide movement of the grounding member is achieved by axially rotating the screw body.

9. The golf club according to claim 1, wherein a center of gravity of the head moves with the slide movement of the grounding member; and adjustment of the center of gravity of the head moving to a back side as the face angle is opened is enabled.

10. The golf club according to claim 1 wherein if a specific gravity of the head body is defined as G1 and a specific gravity of the grounding member is defined as G2, the specific gravity G2 is equal to or less than the specific gravity G1.

11. The golf club according to claim 1, wherein the slide part comprises a slide side surface provided on each of both sides of the slide part;

the slide side surface has an inclination forming an undercut;

the grounding member has a side surface provided on each of both sides of the grounding member;

the side surface of the grounding member has an inclination corresponding to the inclination of the slide side surface;

the grounding member is inserted into the slide part from a backward of the head; and if the grounding member slides, the side surface of the grounding member and the slide side surface slide with each other.

12. The golf club according to claim 1, wherein an adjustable range of the face angle is 2 degrees or greater and 10 degrees or less.

13. The golf club according to claim 1, wherein the plurality of slide positions comprise a plurality of positions in a face-back direction.

14. The golf club according to claim 13, wherein as the grounding member is positioned on a back side, the face angle is opened.

* * * * *